US012595087B2

(12) United States Patent
Mösle

(10) Patent No.: US 12,595,087 B2
(45) Date of Patent: Apr. 7, 2026

(54) METHOD FOR OPERATING A PACKAGING LINE, AND PACKAGING LINE

(71) Applicant: MULTIVAC SEPP HAGGENMÜLLER SE & CO. KG, Wolfertschwenden (DE)

(72) Inventor: Manuel Mösle, Altusried (DE)

(73) Assignee: MULTIVAC SEPP HAGGENMÜLLER SE & CO. KG, Wolfertschwenden (DE)

( * ) Notice: Subject to any disclaimer, the term of this patent is extended or adjusted under 35 U.S.C. 154(b) by 0 days.

(21) Appl. No.: 18/646,136

(22) Filed: Apr. 25, 2024

(65) Prior Publication Data

US 2024/0359853 A1 Oct. 31, 2024

(30) Foreign Application Priority Data

Apr. 26, 2023 (DE) ..... 102023110703.8

(51) Int. Cl.
*B65B 65/00* (2006.01)
*B65B 35/44* (2006.01)
(Continued)

(52) U.S. Cl.
CPC ..... *B65B 65/006* (2013.01); *B65B 35/44* (2013.01); *B65B 35/50* (2013.01); *B65B 57/10* (2013.01)

(58) Field of Classification Search
CPC ..... B65B 65/006; B65B 35/44; B65B 35/50; B65B 57/10; B65B 25/06; B65B 25/068
See application file for complete search history.

(56) References Cited

U.S. PATENT DOCUMENTS 5,209,339 A * 5/1993 Antonissen ..... B65G 43/08 198/817
8,820,202 B2 * 9/2014 Schaub ..... B26D 7/32 83/932

(Continued)

FOREIGN PATENT DOCUMENTS

DE 102021102385 A1 8/2022
DE 102022106471 A1 9/2023
WO 2003057602 A1 7/2003

OTHER PUBLICATIONS

German Search Report for DE Application No. 102023110703.8, dated Jan. 10, 2024, 8 pages.

*Primary Examiner* — Stephen F. Gerrity
*Assistant Examiner* — Nicholas E Igbokwe
(74) *Attorney, Agent, or Firm* — BROOKS KUSHMAN P.C.

(57) ABSTRACT

A method for operating a packaging line including a packaging machine having an insertion station in which one portion is deposited on or in packaging means, a cutting machine for cutting slices from a product, including a discharge conveyor unit capable of forming the slices into portions, and an insertion/feed unit downstream in a passage direction of the cutting machine for buffering and feeding the portions to the insertion station by conveyor belts. Portions are assembled by the insertion/feed unit to a complete format having a predetermined number of portions and the complete format is fed to the insertion station by an insertion belt of the insertion/feed unit. The method includes initially assembling, on a last and/or penultimate conveyor belt of the insertion/feed unit before the insertion belt, an incomplete format, and forming the complete format from the incomplete format only upon transfer of the portions to the insertion belt.

7 Claims, 5 Drawing Sheets

(51) Int. Cl.
*B65B 35/50* (2006.01)
*B65B 57/10* (2006.01)

(56) References Cited

U.S. PATENT DOCUMENTS

| | | | | |
|---|---|---|---|---|
| 2004/0016331 | A1* | 1/2004 | Wolcott | B26D 7/32 83/768 |
| 2012/0042758 | A1* | 2/2012 | Weber | B26D 7/325 83/401 |
| 2012/0192526 | A1* | 8/2012 | Spix | B65B 25/065 53/396 |
| 2014/0299447 | A1* | 10/2014 | Bauer | B65G 37/005 198/418 |
| 2019/0193884 | A1* | 6/2019 | Schmeiser | B65B 35/30 |
| 2019/0283977 | A1* | 9/2019 | Achenbach | B65B 35/44 |
| 2020/0307916 | A1* | 10/2020 | Schröder | B65G 21/12 |

* cited by examiner

METHOD FOR OPERATING A PACKAGING LINE, AND PACKAGING LINE

CROSS-REFERENCE TO RELATED APPLICATIONS

This application claims foreign priority benefits under 35 U.S.C. § 119(a)-(d) to German patent application number DE 102023110703.8, filed Apr. 26, 2023, which is hereby incorporated herein by reference in its entirety.

TECHNICAL FIELD

The disclosure relates to a method for operating a packaging line, and to a packaging line, comprising

- a single-track or multi-track cutting machine, in particular a slicer, which comprises a discharge conveyor unit,
- a packaging machine, and
- an insertion/feed unit between the cutting machine and the packaging machine, in order to feed, in particular weight-tested, portions of one or more slices, cut off by the cutting machine, to an insertion station of the packaging machine, optionally with the track spacing of the multi-track packaging machine correctly aligned.

Both the discharge conveyor unit and the insertion/feed unit can be formed of a plurality of conveyor belts arranged one behind the other in the passage direction through the machine, and, in the case of multi-track cutting machines additionally of a plurality of conveyor belts that are arranged side-by-side, transversely to the passage direction in each case.

An insertion/feed unit of this kind is referred to in practice as an inserter or insertion line. The insertion/feed unit and the discharge conveyor unit of the cutting machine together form a transport stretch, over which the portions have to be transported from formation up until insertion into or onto the packaging element.

The following frequently refers to a slicer, which, however, is not intended to limit the disclosure to this design of cutting machines.

BACKGROUND

In the case of such a packaging line, too, the priority is the performance thereof, usually specified in the form of the clock cycle with which the packaging elements, which generally move forward in a stepwise manner, are moved in the packaging machine.

Since the packaging machine is usually a deep-drawing packaging machine, in which a strip of a plastics film, capable of being deep-drawn, is deep-drawn in portions, during standstill, immediately upstream of the insertion station, at which the portions are deposited on or in the packaging elements, as a result of which deep-drawing packaging troughs are formed in the film strip, usually a plurality of packaging troughs one behind the other per track, in the passage direction, per deep-drawing process.

The number and arrangement of packaging troughs produced in a single deep-drawing process, or the corresponding number and arrangement of portions to be inserted into said troughs, is referred to as a format. In the case of a multi-track cutting machine or a multi-track packaging machine the troughs or the corresponding portions form a two-dimensional format.

A format can thus be formed of a plurality of portions or rows of portions arranged one behind the other in the passage direction—in this case, a row of portions refers to a plurality of portions transversely to the passage direction—the portions of a format preferably being aligned with one another, in particular in a flush manner, both in the passage direction and transversely to the passage direction, and in each case are at a predetermined, in particular in each case equal, spacing from one another both in the passage direction and transversely to the passage direction.

Since on account of the stepwise deep-drawing process (deep-drawing stroke) the film strip can also be moved forwards, in a stepwise manner, at the insertion station, in each case a complete format of portions can be inserted in a stroke-wise manner (insertion stroke=deep-drawing stroke) into a corresponding format of troughs at the insertion station, during its forward movement.

The insertion/feed unit on the one hand assembles the portions to the correct formats, and on the other hand constitutes a buffer for portions, in order that, in the case of an interruption of the cutting operation—which regularly occurs during loading of the slicer with one or more new product types—the packaging machine can continue to work, supplied from said buffer.

In this case, in the cutting machine according to the prior art in general not only portions, but rather also complete formats, are buffered. If, however, in the passage direction, formats are already formed on one of the first conveyor belts of the insertion/feed unit, which in this connection is also referred to as a format belt, the positions of the individual portions of a respective format can slip again, due to a plurality of belt transitions until reaching the insertion belt, and must correspondingly be corrected again before insertion into the packaging troughs.

A cutting performance of the cutting machine is also generally higher than an insertion performance of the insertion/feed unit and/or the packaging machine, as a result of which the speed at which the portions can be fed from the discharge conveyor unit of the cutting machine to the insertion/feed unit, is usually limited by the insertion performance of the insertion/feed unit and/or of the packaging machine. This is noticeable in particular if the cutting machine returns to cutting operation again following a loading process with new product types, since in this case the buffer stretch that was emptied during loading must be filled with portions again. If, in this case, the format formation, which is generally the slowest, i.e. most time-consuming, station in the packaging line, is already taking place on one of the first conveyor belts of the insertion/feed unit, in the passage direction, the portions of the buffer stretch and finally the insertion belt can be fed only comparatively slowly, which can lead to an undesired high increase of the average clock cycle of the cutting machine.

SUMMARY

The problem addressed according to the disclosure is therefore that of providing a method for operating a packaging line, which method is capable of minimizing, in particular of preventing, an increase in an average clock cycle of the packaging line, in particular of the packaging machine, on account of an interruption of the cutting operation of the cutting machine, and in the process to provide format formation that is as accurately positioned as possible, and to provide a packaging line suitable for this, without significantly increasing the structural outlay for the packaging line.

In a method of the type in question for operating a packaging line which comprises a packaging machine having an insertion station in which one portion can be deposited on or in a packaging means, a single-track or multi-track cutting machine, in particular a slicer, for cutting off slices from a product type, including a discharge conveyor unit, in particular having a plurality of conveyor belts one behind the other, for the slices, the discharge conveyor unit being capable of laying a plurality of slices on top of one another, at least in part, to form a portion, and an, in particular horizontal, insertion/feed unit which is downstream in the passage direction of the cutting machine and is intended for buffering and feeding the portions to the insertion station by means of a plurality of conveyor belts, of which the conveyor belts that are arranged within a buffer stretch, and in particular are equipped with controllable servo-drives, are used as buffer belts, the portions are assembled by the insertion/feed unit to a format, each format comprising at least one predetermined number of portions in the passage direction, which are each at a predetermined distance from one another in the passage direction, and the format is fed to the insertion station by means of an insertion belt of the insertion/feed unit.

According to the disclosure, firstly a format that is incomplete in the passage direction is assembled on the last and/or penultimate conveyor belt of the insertion/feed unit before the insertion belt, in the passage direction, and only upon transfer of the portions onto the insertion belt is a complete format formed from the incomplete format.

The format formation thus takes place as late as possible, specifically during the transfer of the portions onto the insertion belt, such that a number of belt transitions after the assembly of the complete format is minimized, as a result of which slipping of the portions, assembled to a format, relative to one another can also be minimized, or at best prevented entirely. Consequently, according to the disclosure, formats can be formed which have a high degree of positioning accuracy, preferably without retrospective position correction of the individual portions, since a complete format is not, as in the prior art, exposed to a plurality of belt transitions until it reaches the insertion station.

In this case, the last and/or penultimate conveyor belt of the insertion/feed unit before the insertion belt, in the passage direction, can be designed as a format belt, in the case of which the portions of the format are aligned to one another in the passage direction in such a way that they are at a predetermined spacing from one another in the passage direction.

Moreover, according to the disclosure, an increase in an average clock cycle of the packaging machine on account of an interruption of the cutting operation of the cutting machine can be minimized, in particular prevented, since, owing to the fact that no complete formats are buffered on the buffer stretch, a buffer stretch that is partially or completely emptied during loading of the cutting machine can be filled with portions again relatively quickly. The portions can thus be transferred comparatively quickly from the cutting machine, in particular the discharge unit thereof, to the buffer stretch at the start of the cutting operation of the cutting machine newly loaded with product types, since no complete formats are buffered, and the format formation takes place only at a point that is downstream of the buffer stretch in the passage direction.

In principle, the incomplete format can differ as desired from the complete format, for example with respect to at least one property, such as a number of portions, a number of rows of portions, or the like. However, the incomplete format preferably differs from the complete format at least in that it does not comprise a last portion or last row of portions of a complete format in the passage direction, the complete format being formed in that the last portion or the last row of portions of a complete format is added to the incomplete format only upon transfer of the portions, in particular at least the predetermined number of portions in the passage direction, to the insertion belt. Consequently, the incomplete formats can be formed on the last and/or penultimate conveyor belt of the insertion/feed unit before the insertion belt, in the passage direction, and the last portion or the last row of portions can be connected to the incomplete format only upon transfer to the insertion belt. This also makes it possible for the buffer stretch to be able to buffer an increased number of portions which are not yet present as formats, at the same length of the insertion/feed unit in the passage direction. This is due to the fact that the last and/or penultimate conveyor belt before the insertion belt, in the passage direction, can have an extension in the passage direction which is shorter than the extension of a complete format in the passage direction, since the complete format is formed only upon transfer of the portions to the insertion belt. It is thus conceivable in principle that, upon transfer of the portions to the insertion belt, the frontmost portion in the passage direction is already located entirely or in part on the insertion belt, when the last portion or last row of portions is added to the incomplete format.

As already mentioned at the outset, in the case of a multi-track cutting machine the format is preferably a two-dimensional format, it being possible for a predetermined number of portions, transverse to the passage direction, to in each case correspond to a row of portions. In this case, in the case of a multi-track cutting machine the predetermined number of portions of a row preferably corresponds to the number of tracks of the cutting machine.

Preferably, upon transfer of the portions to the insertion belt, in order to form the complete format, a conveyor belt of the insertion/feed unit that is, in particularly directly, upstream of the last and/or penultimate conveyor belt in the passage direction, can be driven in the passage direction, before the last and/or the penultimate conveyor belt is driven in the passage direction. If the incomplete format is defined in that it, as described above, does not comprise the last portion or the last row of portions of a complete format, then the last portion or the last row of portions can be added to the incomplete format at a spacing in the passage direction that is correct for the complete format.

In order to be able to assemble the portions, to a format, in a precisely positioned manner in the passage direction, a position of a respective portion, in particular of a front end of the respective portion in the passage direction, can be acquired upstream of the last or penultimate conveyor belt of the insertion/feed unit, before the insertion belt, in the passage direction of the cutting machine, by means of a, preferably optical, sensor unit. If, in this case, an optical sensor unit is used, the position of a respective portion, in particular the front end of the respective portion in the passage direction, can be detected in a contactless manner upon transfer to the last or penultimate conveyor belt of the insertion/feed unit before the insertion belt in the passage direction. Furthermore, this makes it possible to ensure or check that the portions of a respective row of portions still have a correct alignment relative to one another in the longitudinal direction, before or during format formation, which can yet further improve the quality of the insertion result of the insertion/feed unit.

In principle, it is already possible to ensure, by means of the above-described approach, that the average clock cycle of the packaging machine increases only slightly, or at best not at all, on account of an interruption of the cutting operation of the cutting machine. In order to furthermore also be able to ensure that formats can also be formed for as long as possible, in terms of time, during loading of the cutting machine, preferably a number of portions in the passage direction can be buffered simultaneously, which number is higher than the predetermined number of portions of an, in particular complete, format in the passage direction, during a cutting operation of the cutting machine, on a buffer belt of the buffer stretch. As a result, the buffer stretch can be used particularly effectively, and thus the insertion performance of the insertion/feed unit can be further optimized.

In this case, the cutting operation refers to the operation of the cutting machine in which a product type or a plurality of product types is/are cut into slices simultaneously. During loading operation of the cutting machine, in contrast, no slices are cut, but rather the cutting machine is loaded with a product type, after for example a previous product type has been cut, apart from an offcut. Thus, during the loading operation, the portions buffered on the buffer stretch can be used to form formats which are fed to the packaging machine by means of the insertion belt, as a result of which a packaging performance of the packaging machine can be increased.

In this case, in the case of a multi-track cutting machine, in a corresponding manner a number of rows of portions can be buffered at the same time on a buffer belt of the buffer stretch, which number is higher than the number of rows of an, in particular complete, format.

Furthermore, if the cutting machine is a multi-track cutting machine having a plurality of tracks, portions, located on adjacent tracks, before the buffer stretch in the passage direction, can be moved into a, preferably exactly, identical position in the passage direction, in particular by means of a compensation belt of the insertion/feed unit. A, preferably optical, sensor unit can also be arranged on the compensation belt, in order to be able to acquire the positions of the portions of a respective row of portions, in the passage direction.

Additionally or alternatively, if the cutting machine is a multi-track cutting machine having a plurality of tracks, in a manner that is known per se portions, located on adjacent tracks, before the buffer stretch in the passage direction, can be brought to a track spacing of the tracks of the packaging machine, preferably by means of a distributor belt or a spreader belt of the insertion/feed unit.

In order to finally package the portions assembled to a complete format, the packaging means can be moved forwards in a stepwise manner in the packaging machine, in each case receiving a complete format, consisting of a plurality of portions, in particular per track.

A packaging line of the type in question for the production and packaging of portions that each consist of one or more slices cut off from a product type comprises

- a packaging machine having an insertion station in which one portion can be deposited on or in a packaging means,
- a single-track or multi-track cutting machine, in particular a slicer, for cutting off slices from a product type, including a discharge conveyor unit, in particular having a plurality of conveyor belts one behind the other, for the slices, the discharge conveyor unit being capable of laying a plurality of slices on top of one another, at least in part, to form a portion,
- an, in particular horizontal, insertion/feed unit which is downstream in the passage direction of the cutting machine and is intended for buffering and feeding the portions to the insertion station by means of a plurality of conveyor belts, conveyor belts of the insertion/feed unit arranged within a buffer stretch being designed to be used as buffer belts for buffering portions, the insertion/feed unit

- comprising at least one format belt which is designed to assemble portions, in an exactly positioned manner, to form at least one format, and
- an insertion belt which is designed to transfer the format to at least one packaging means at the insertion station, in particular to drop it onto said packaging means, and

- a controller for controlling movable parts of the packaging line.

According to the disclosure

- a last and/or penultimate conveyor belt of the insertion/feed unit before the insertion belt, in the passage direction of the cutting machine, is in each case designed as a format belt, and
- the packaging line, in particular its controller, is designed in such a way that it is capable of carrying out the method according to any of the preceding claims.

Already at this point it should be noted that all the statements, advantages and effects described for the method according to the disclosure also apply to the packaging line according to the disclosure, and vice versa.

According to one embodiment, the penultimate conveyor belt before the insertion belt, in the passage direction of the cutting machine, can correspond to a first format belt, and the last conveyor belt before the insertion belt, in the passage direction of the cutting machine, can correspond to a second format belt, it being possible for the first format belt to be of a shorter length, in the passage direction, than the second format belt. In this case, the first format belt can preferably be designed to buffer just one, in particular penultimate, row of a complete format.

Furthermore, the packaging line can comprise at least one sensor unit, which can preferably be designed as an optical sensor unit, it being possible for the at least one sensor unit to be arranged, in particular directly, upstream of the last or penultimate conveyor belt of the insertion/feed unit in the passage direction of the cutting machine, in front of the insertion belt. The sensor unit can for example be designed as a light barrier, a laser, a camera, or the like. Thus, for format formation, a position of a portion, in particular the front end of a portion in the passage direction, can be acquired by means of a light barrier, in order to be able to assemble the portions in an exactly positioned manner in the passage direction. to form a format.

The packaging line can furthermore comprise, preferably one behind the other in the passage direction,

- a weighing belt comprising scales for weighing a portion, and/or
- a discharge belt, in particular a compensator belt, for discharging a portion, and/or

- a distributor belt or spreader belt for bringing portions traveling side-by-side to the track spacing of the packaging machine, and/or

- a compensation belt for bringing portions traveling side-by-side in the passage direction into an, in particular exactly, identical position.

Additionally or alternatively, the discharge conveyor unit can further comprise, in addition to the portioning belt, a following output belt for transporting the portion away from the portioning belt, and/or a transfer belt for transferring a portion to a following unit, in particular the insertion/feed unit.

The intended aim can be achieved very easily by means of said conveyor belts in the packaging line.

BRIEF DESCRIPTION OF THE DRAWINGS

Embodiments of the disclosure are explained in more detail below by means of the Figures. Therein.

DETAILED DESCRIPTION

Figure 1:
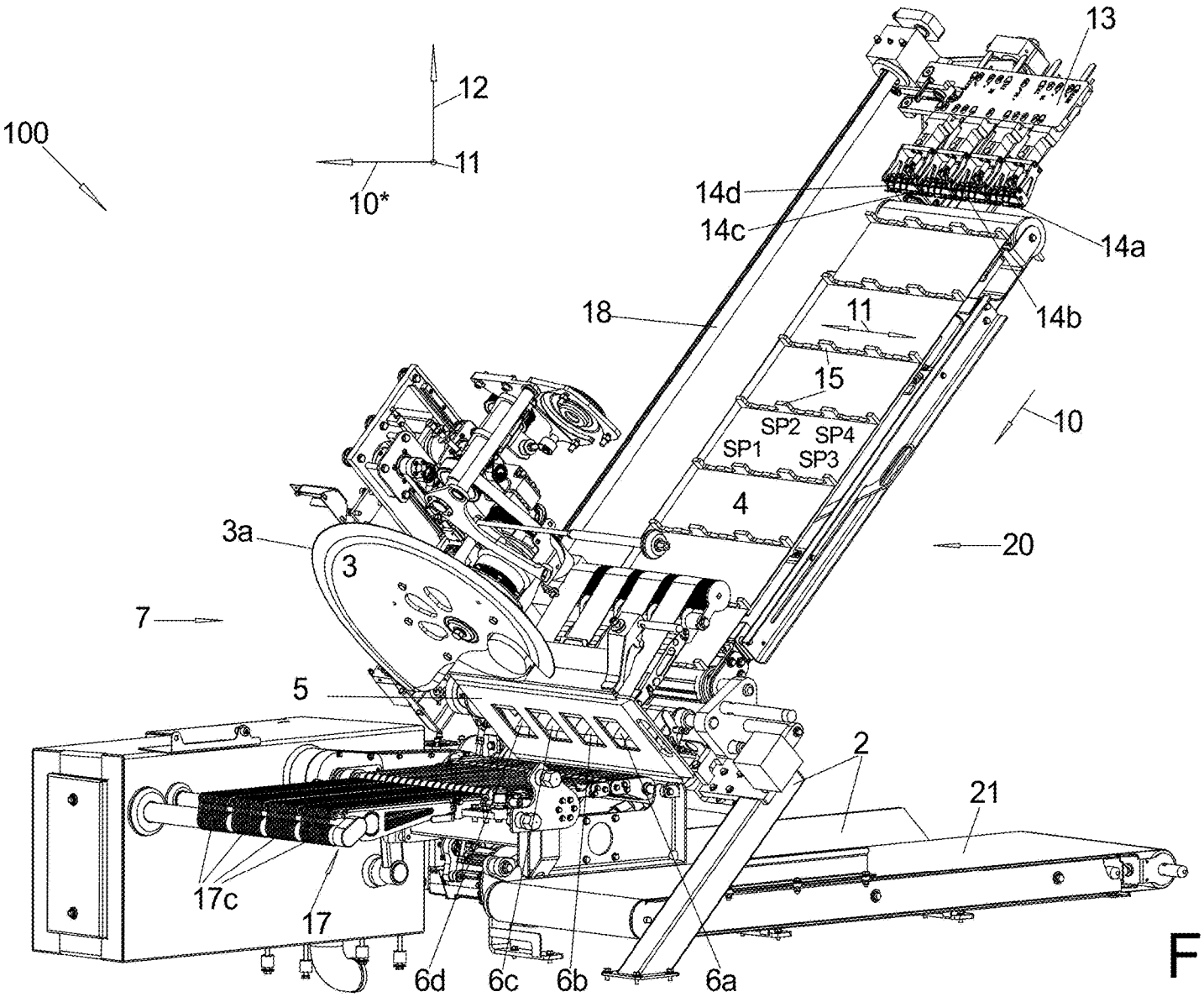
FIG. 1 shows various perspective views of a cutting machine in the form of a slicer, having the feed belt folded up in the cutting position.

FIG. 1 shows a multi-track cutting machine, which is known in principle, in the form of a slicer 100 for simultaneously cutting a plurality of product types K (not shown in these two figures) side-by-side on one track SP1 to SP4 in each case, and depositing them in shingled portions P each consisting of a plurality of slices S, having a general passage direction 10* through the slicer 1 from right to left.

The units of the slicer 100 are fixed to a base frame 2. The longitudinal direction 10 is the feed direction of the type K to the cutting unit 7, and thus also the longitudinal direction of the type K located in the slicer 100.

In this case, it can be seen that the basic structure of a slicer 100 according to the prior art consists in a plurality of, in this case four, product types K lying transversely to the feed direction 10 and side-by-side on a feed conveyor 4, having spacers 15 of the feed conveyor 4 therebetween, are fed from said feed unit 20 to a cutting unit 7 comprising a blade 3, here a curved blade 3, rotating about a blade axis 3', from the front ends of which product types the rotating blade 3 separates a slice S, with its cutting edge 3*a*, in one work step in each case, i.e. almost simultaneously.

For cutting the product type K, the feed conveyor 4 is located in the, in side view oblique, cutting position, shown in FIG. 1, having lower, cutting-side front end and higher, rear end, out of which position it can be folded down, about a pivot axis 20' extending in the width direction thereof, the first transverse direction 11, and located in the vicinity of the cutting unit 7, into an approximately horizontal loading position.

The rear end of each type K located in the feed unit 20 is in each case held in a form-fitting manner by a gripper 14*a-d*, with the aid of activatable and deactivatable gripper claws 16. The grippers 14*a*-14*d* are fixed to a common gripper carriage 13, which can be fed along a gripper guide 18 in the feed direction 10.

In this case, both the advancement of the gripper carriage 13 and of the feed conveyor 4 can be driven in a controlled manner, the specific feed speed of the types K, however, being brought about by what is known as an upper and lower product guide 8, 9, which are also driven in a controlled manner and which engage on the top and bottom of the types K to be cut, in the front end regions thereof close to the cutting unit 7.

The front ends of the types K are in each case guided through what is known as a product opening 6*a-d* of a plate-shaped cutting frame 5, the cutting plane 3" extending immediately in front of the front, obliquely downward-facing end face of the cutting frame 5, in which plane the blade 3 rotates with its cutting edge 3*a*, and thus cuts off the excess of the type K from the cutting frame 5 as a slice S. The cutting plane 3" extends perpendicularly to the upper run of the feed conveyor 4 and/or is spanned by the two transverse directions 11, 12 relative to the feed direction 10.

In this case, the inner periphery of the product openings 6*a-d* of the cutting edge 3*a* of the blade 3 serves as a counterblade.

Since both product guides 8, 9 can be driven in a controlled manner, in particular independently of one another and/or possibly separately for each track SP1 to SP4, these determine the—continuous or clocked—advancement speed of the type K through the cutting frame 5.

Usually an approximately horizontally extending remainder conveyor 21 is located below the feed conveyor unit 20, which remainder conveyor begins with its front end under the cutting frame 5 and directly under or behind the discharge conveyor unit 17 and, by means of its upper run, transports away, downwards, remainders falling thereon—by means of a drive of one of the discharge conveyors 17, counter to the passage direction 10.

The slices S which are oblique in space upon separation fall onto a discharge conveyor unit 17 that begins under the cutting frame 5 and extends in the passage direction 10*, which in this case consists of a plurality of discharge means 17*a, b, c* arranged one behind the other having their upper runs approximately flush, in the passage direction 10*, of which discharge means the first discharge means 17*a* in the passage direction 10 can be designed as a portioning belt 17*a*.

The slices S can strike the discharge conveyor unit 17 individually and in a manner spaced apart from one another in the passage direction 10*, or form shingled (see FIGS. 2*a, b*) or stacked portions P by a usually stepwise forward-moving portioning belt 17*a* by corresponding of the controller of the portioning belt 17*a* of the discharge conveyor unit 17—the movement of which, like almost all the moving parts, is controlled by the controller 1*. In that regard, as one skilled in the art would understand, the controller 1*, as well an any other unit, machine, apparatus, element, sensor, device, component, system, subsystem, arrangement, or the like described herein may individually, collectively, or in any combination comprise appropriate circuitry, such as one or more appropriately programmed processors (e.g. one or more microprocessors including central processing units (CPU)) and associated memory, which may include stored operating system software and/or application software executable by the processor(s) for controlling operation thereof and/or for performing the particular algorithms represented by the various functions and/or operations described herein, including interaction and/or cooperation between any such controller, unit, machine, apparatus, element, sensor, device, component, system, subsystem, arrangement, or the like. One or more of such processors, as well as other circuitry and/or hardware, may be included in a single ASIC (Application-Specific Integrated Circuitry), or several processors and various circuitry and/or hardware may be distributed among several separate components, whether individually packaged or assembled into a SoC (System-on-a-Chip).

Figure 2A:
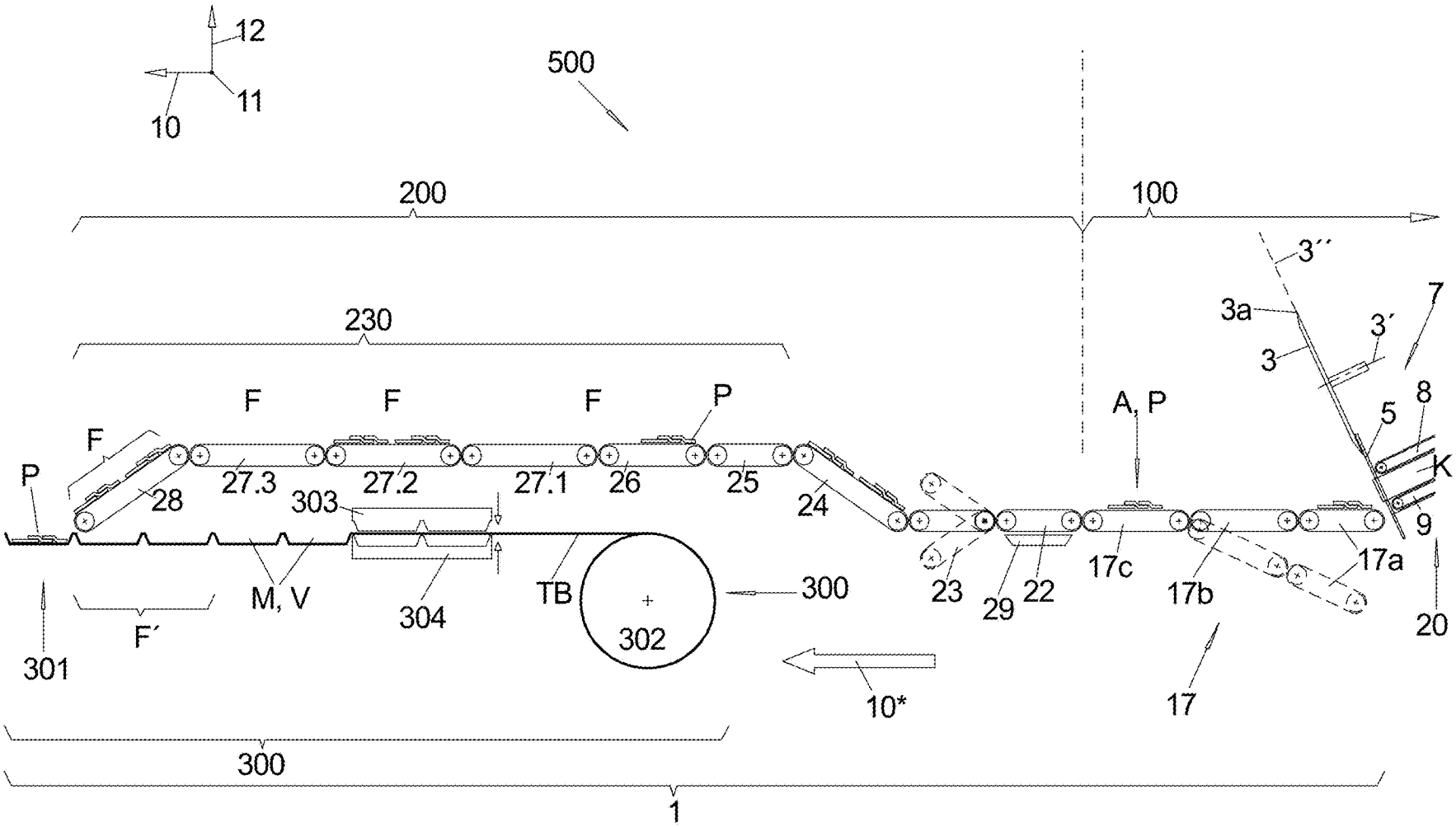
Fig. 2a prior art
FIG. 2A is a side view of an embodiment of a packaging line according to the prior art.
Figure 2B:
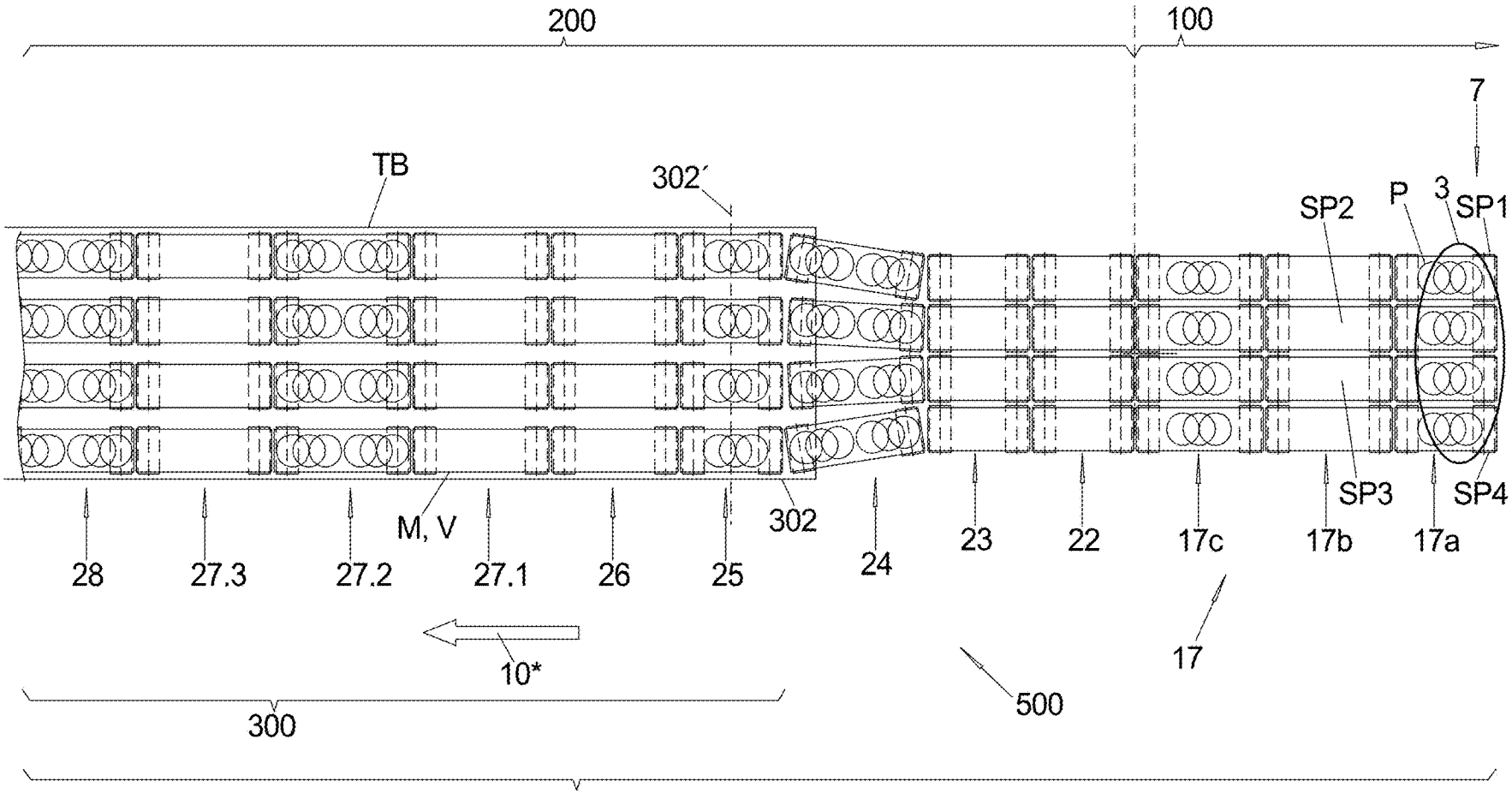
Fig. 2b prior art
FIG. 2B is a view from above of the packaging line from FIG. 2*a* in a four-track design.

FIGS. 2*a* and 2*b* are a side view and a plan view, respectively, of a packaging line 1 according to the prior art, having an insertion/feed unit 200, adjoining a slicer 100 in the passage direction 10*, with discharge conveyor unit 17, and a packaging machine 300 indicated by a trough belt, into the troughs M of which the insertion/feed unit 200 deposits the portions P, in particular a portion P consisting of three slices S in each case, as shown.

The side view of FIG. 2*a* applies both for a single-track packaging line 1 and also for a multi-track packaging line 1 having a plurality of tracks located one behind the other in the viewing direction of this figure, for example a four-track packaging line 1, as shown in the plan view of FIG. 2*b*.

The packaging line 1 shown in FIGS. 2*a* and 2*b* comprises, on each of the tracks SP1 to SP4, downstream proceeding from the cutting unit 7, the following conveyor belts:

a portioning belt 17*a*,
an output belt 17*b*, and
a transfer belt 17*c* as components of the discharge conveyor unit 17, which as a rule still belongs to the slicer 100.

Downstream, in particular immediately downstream, thereof the packaging line 1 comprises, preferably in this order,

- a weighing belt 22 comprising scales 29 for weighing a portion P located thereon,
- a controlled discharge belt 23, preferably designed as a compensator belt 23 that can be pivoted in a controlled manner, for discharging a portion P of incorrect weight,
- a distributor belt 24, frequently also referred to as a spreader belt 24, for bringing the portions located side-by-side in the transverse direction 11 from the track spacing of the slicer 100 to the track spacing of the packaging machine 300,
- a compensation belt 25 for bringing the portions P located side-by-side in the transverse direction 11 to exactly the same longitudinal position in the passage direction 10*, and
- a format belt 26 for assembling the corresponding number of portions P—in the example according to the prior art, two portions P one behind the other per track—for a format F and bringing them to the correct longitudinal spacing, and thus forming finished formats F.

This is adjoined downstream by the actual buffer stretch 230, consisting of one or more, in the present case according to the prior art three, buffer belts 27.1-27.3, in the present case the compensation belt 25 and the format belt 26 also still belonging to the buffer stretch 230, since they can likewise—apart from the above-mentioned functions—also fulfil a buffer function, as buffer belts.

The buffer belts 27.3 and 27.2 can in each case receive at least one format F of portions P, the buffer belt 27.1, in contrast, only a part of a format F, in this case just one portion, while the immediately upstream format belt 26 can likewise receive a portion P, such that the two can together buffer a format F.

At the end, the obliquely downwardly-directed insertion belt 28 follows, which belt deposits the format F stored thereon, consisting in this case of eight portions P, corresponding to two rows of four portions P each, on the deep-drawing belt TB in the analogous format F' there consisting of troughs M of the deep-drawing belt TB, for which purpose the deep-drawing belt TB and the insertion belt 28 can be brought to the same speed in the passage direction 10*.

Of course, the successive belts are arranged so close together that they are capable of transferring a corresponding portion P from the preceding upstream belt and passing it onto the next, downstream belt.

The length of the format F, F' in the passage direction 10* and/or the clock frequency and the speed in their movement phases are specified by how many troughs M are deep-drawn one behind the other in the passage direction 10*—and of course side-by-side in the transverse direction 11, generally simultaneously over all the tracks—in the deep-drawing station between the upper die 303 and the lower die 304, out of the flat deep-drawing belt TB.

Figure 3B:
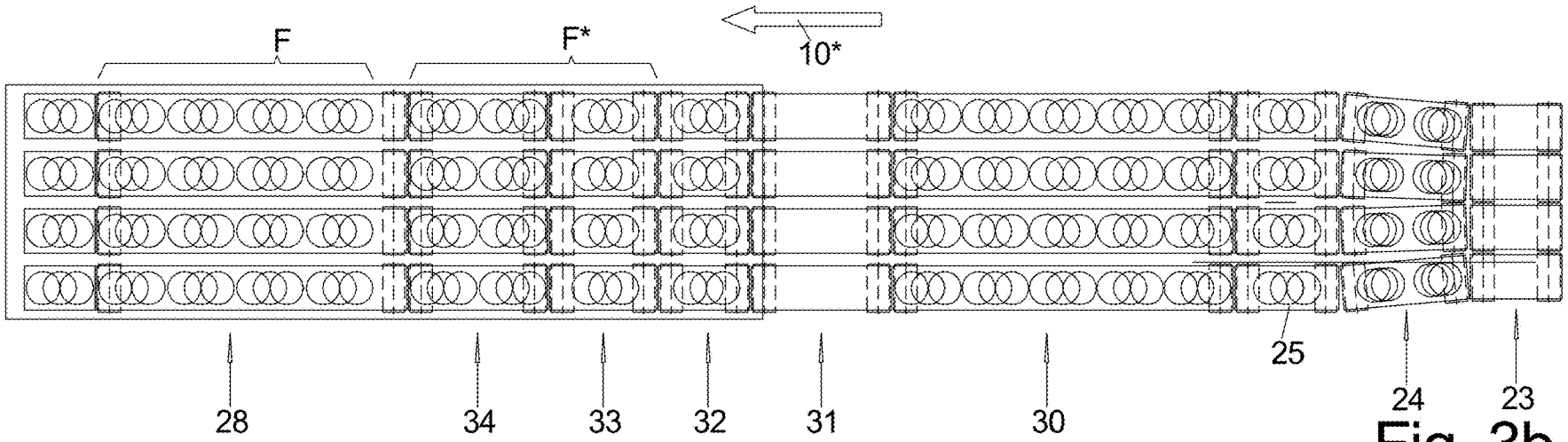
FIG. 3B is a view from above of the packaging line from FIG. 3*a* in a four-track design.
Figure 3A:
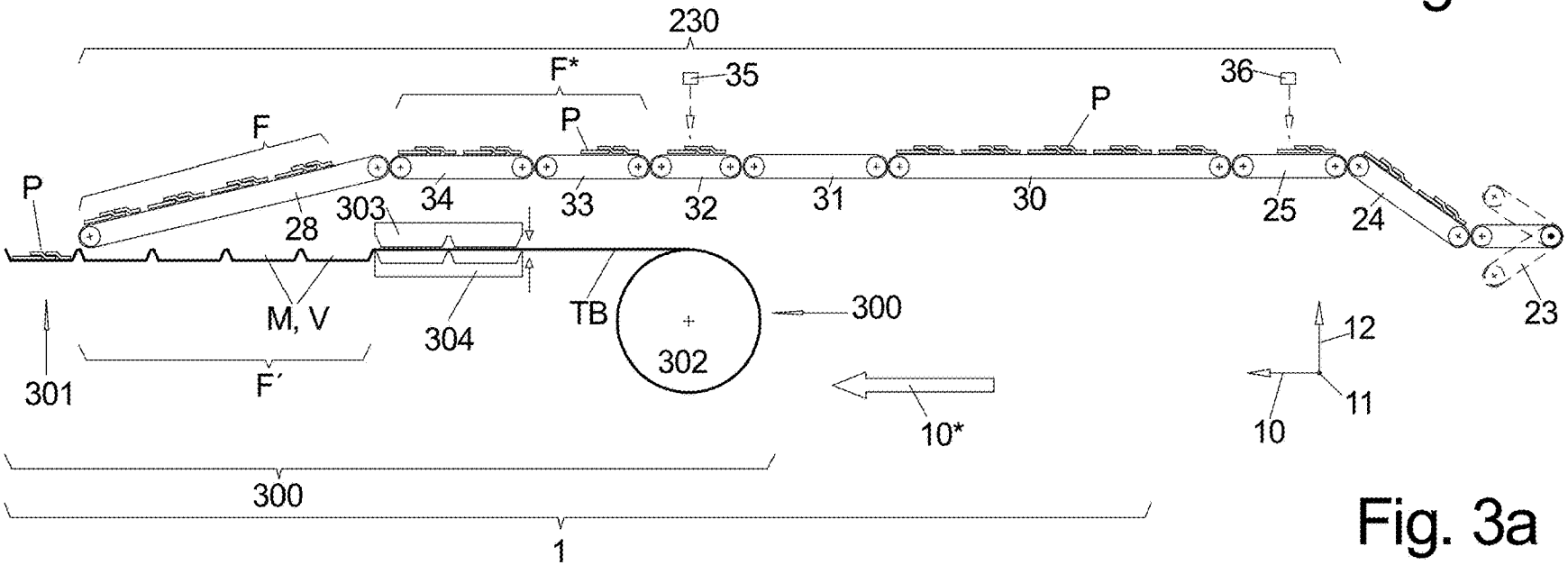
FIG. 3A is a side view of an embodiment of a packaging line according to the disclosure, the weighing belt and the cutting machine, including its discharge conveyor unit, not being shown for reasons of clarity.

FIGS. 3*a* and 3*b* are a side view and a plan view, respectively, of a packaging line 1 according to the disclosure, for reasons of clarity the discharge conveyor unit 17 and the weighing belt 22 not being shown. In this case, the discharge conveyor unit 17, the weighing belt 22 and the cutting machine in the form of the slicer 100 of the packaging line 1 according to the disclosure can in principle be of the configuration according to the prior art, described above in FIGS. 1, 2*a* and 2*b*. This preferably also applies for the discharge belt 23, the distributor belt 24 and the compensation belt 25.

In contrast to the solution according to the prior art, according to the embodiment according to the disclosure that is shown according to FIGS. 3*a* and 3*b* not a format belt, but rather a buffer belt 30, is arranged immediately downstream of the compensation belt 25, which buffer belt can simultaneously receive, i.e. buffer, five portions one behind the other in the passage direction 10* on each of the tracks SP1 to SP4. In turn, a further buffer belt 31 can follow the buffer belt 30, which further buffer belt, in the embodiment shown, is designed to be shorter in the passage direction 10* than the buffer belt 30, and can correspondingly simultaneously receive a smaller number of portions P, in the present case at most two portions.

Thus, according to the disclosure, merely portions but not yet complete formats F are buffered on the buffer belts 30 and 31. The formation of the formats F, which, in the embodiment according to the disclosure that is shown, each consist of four portions P, one behind the other, per track, takes place only further downstream in the passage direction 10*. Of course, however, a format F can also have any other number of portions P, for example in each case two, three or five portions P, one behind the other, per track. In order to form formats F, according to the embodiment shown the last 33 and/or penultimate 34 conveyor belt of the insertion/feed unit 200 before the insertion belt 28, in the passage direction 10* of the slicer 100, is in each case designed as a format belt. In this case, the format belts 33 and 34 are designed to firstly form incomplete formats F*, as shown in FIGS. 3*a* and 3*b*.

In this case, the incomplete format F* can differ from the complete format F at least in that it does not comprise a last portion P or, in the case of the multi-track slicer 100 that is shown, last row of portions P, in the passage direction 10*, of a complete format F. As can be seen in FIGS. 3*a* and 3*b*, only three rows of portions P are located on the format belts 33 and 34, which corresponds to the incomplete format F*, while a complete format F, according to the embodiment shown, comprises four rows of portions P, as visible for example on the insertion belt 28. FIGS. 3*a* and 3*b* thus show a state before a complete format F is transferred from the format belts 33, 34 to the insertion belt 28, and therefore an incomplete format F* is located on the format belts 33, 34, in a waiting position.

In this case, a complete format F is formed in that the last row of portions P of a complete format F, in the passage direction 10*, is added to the incomplete format F* only upon transfer of the portions P from the format belts 33 and 34 to the insertion belt 28.

Figure 4B:
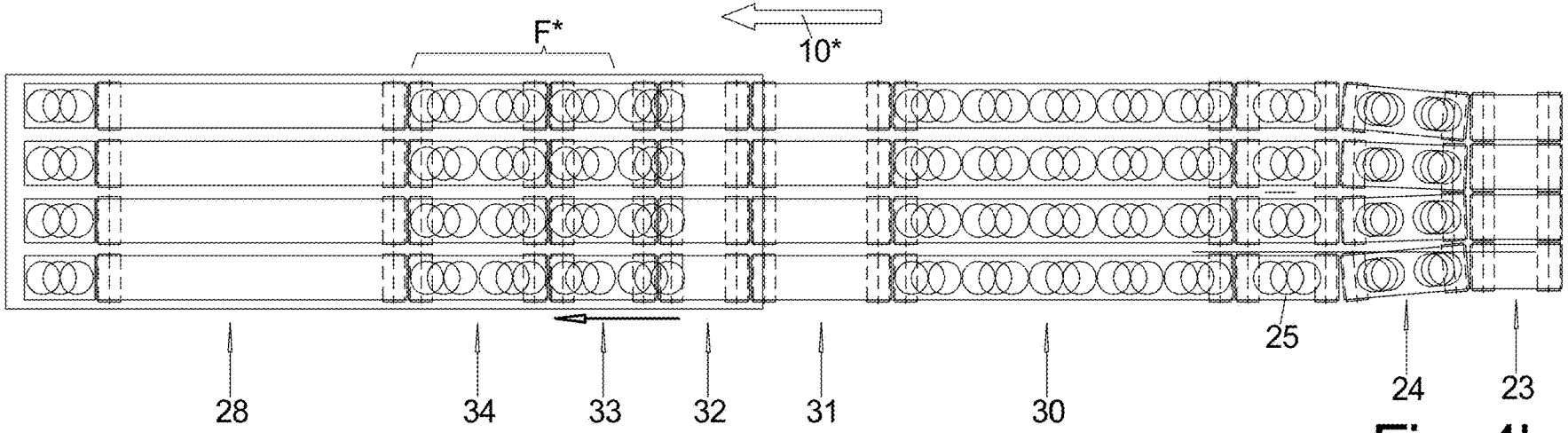
FIG. 4B is a view from above of the packaging line from FIG. 4*a* in a four-track design.
Figure 4A:
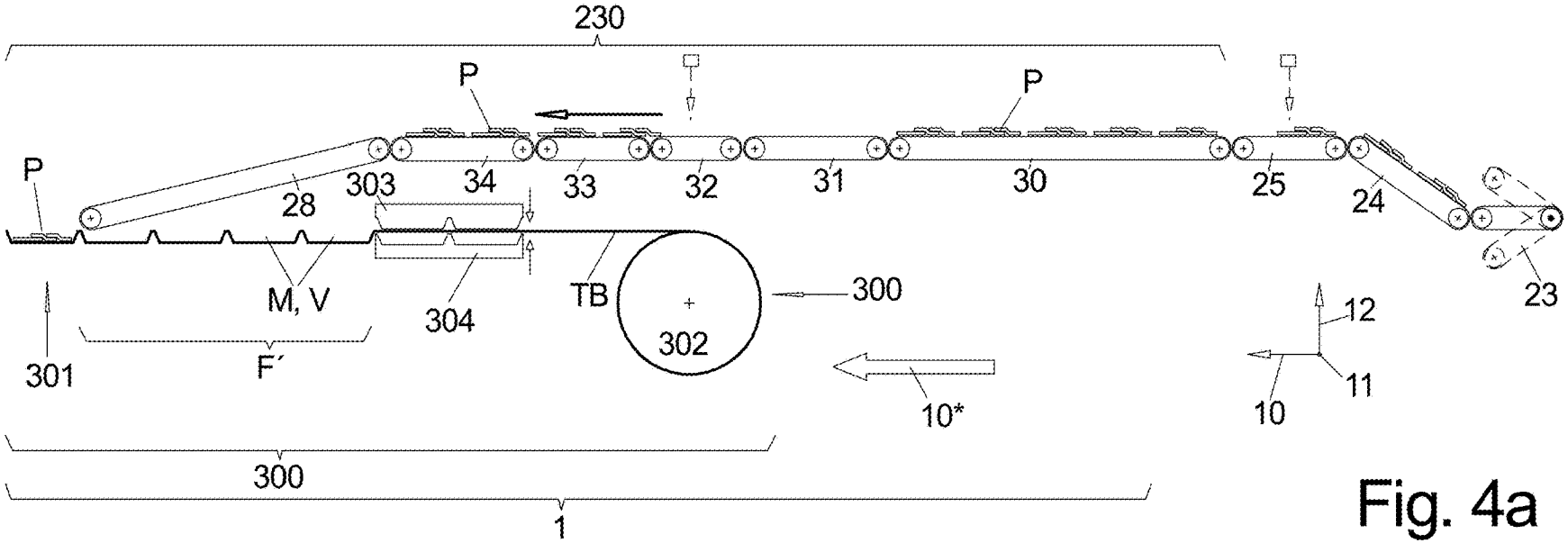
FIG. 4A shows the packaging line from FIG. 3*a*, but in a state during transfer of a complete format to an insertion belt.

FIGS. 4*a* and 4*b* show a state during a transfer of a complete format F to the insertion belt 28. As can be seen in FIGS. 4*a* and 4*b*, upon transfer of the portions P onto the insertion belt 28, a conveyor belt 32, which is a conveyor belt of the insertion/feed unit 200 that is directly upstream of the two format belts 33 and 34 in the passage direction 10*, is driven in the passage direction 10*, before the format belt 33 and/or the format belt 34 is driven in the passage direction 10*. It is thus possible to ensure that the last row of portions P of the complete format F is added to the incomplete format F*, in particular at a correct spacing for the compete format F, in a passage direction 10*, upon transfer of the portions P to the insertion belt 28. After the last row of portions P in the passage direction 10* is at a correct spacing, in the passage direction 10*, from the penultimate row of portions P in the passage direction 10*, the format belts 33 and 34 are driven in such a way that the compete format F can be fed to the insertion belt 28.

Thus, there is preferably never a complete format F located on the format belts 33 and 34, since, as shown in FIG. 4*a*, the sum of the extensions of the two format belts 33 and 34 in the passage direction 10* can be shorter than the extension of a complete format F in the passage direction 10*. This is visible in FIG. 4*a* in that the last portion P of a complete format, F in the passage direction 10*, is still located in part on the conveyor belt 32 when the first portion P of said complete format, in the passage direction 10*, has already reached a front end of the format belt 34 in the passage direction 10*.

In order to in the process be able to in each case correctly orient the portions P for a format F, in an exactly positioned manner in the passage direction 10*, in the embodiment shown an optical sensor unit 35 can be arranged on the conveyor belt 32, upstream of the format belts 33 and 34 in the passage direction 10*, which sensor unit is designed to acquire a position of a respective portion P, in particular a front end of a respective portion P, in the passage direction 10*. In this case, the optical sensor unit 35 can be communicatively connected to the controller 1*. Furthermore, the optical sensor unit 35 can for example be designed as a light barrier, a laser, a camera, or the like. Moreover, a further optical sensor unit 36 can be provided, which sensor unit, in the embodiment shown, is arranged on the compensation belt 25 and can substantially correspond to the optical sensor unit 35. Thus, for example the feed of portions onto the buffer belts 30 and 31 can be controlled and/or monitored using the further optical sensor unit 36.

In order to furthermore also be able to ensure that complete formats F can also be formed for as long as possible, in terms of time, during loading of the slicer 100, preferably a number of portions P in the passage direction 10* can be buffered simultaneously, which number is higher than the number of portions P of a complete format F in the passage direction 10*, during a cutting operation of the slicer 100, on the buffer belts 30 and 31, and in particular on the conveyor belt 32 and/or compensation belt 25, of the buffer stretch 230. As a result, the buffer stretch 230 can be used particularly effectively, and thus the insertion performance of the insertion/feed unit 200 can be further optimized. This is made possible in particular in that, according to the disclosure, merely portions P, but not complete formats F, are buffered upstream of the insertion belt 28 in the passage direction 10*, as a result of which a buffer belt, such as here for example the buffer belt 30 can simultaneously receive more portions P, in the passage direction 10*, than corresponds to a complete format F.

Moreover, according to the embodiment shown here, an increase in an average clock cycle of the slicer 100 on account of an interruption of the cutting operation of the slicer 100 can be minimized, since, owing to the fact that no complete formats F are buffered on the buffer stretch, the buffer stretch 230 that is partially or completely emptied during loading of the slicer 100 can be filled with portions P again relatively quickly. The portions P can thus be transferred comparatively quickly to the buffer stretch 230 at the start of the cutting operation of the slicer 100 newly loaded with product types K, since no complete formats F are buffered, and the format formation takes place only during the transfer of the portions P onto the insertion belt 28.

LIST OF REFERENCE NUMBERS

1 packaging line
1* controller
2 base frame
3 blade
3 axis of rotation
3" blade plane, cutting plane
**3*a*** cutting edge
4 feed conveyor, feed belt
5 cutting frame
**6*a-d*** product opening
7 cutting unit
8 upper product guide, upper guide belt
8.1 contact run, upper run
**8*a*** spectacles-side deflection roller
**8*b*** deflection roller remote from the spectacles
9 lower product guide, lower guide belt
8.1 contact run, upper run
**9*a*** spectacles-side deflection roller
**9*b*** deflection roller remote from the spectacles
10 feed direction, type
10* passage direction through machine
11 1st transverse direction, width direction
12 vertical
13 gripper unit, gripper carriage
14, **14*a-d*** gripper
15 spacer
16 gripper claw
17 discharge conveyor unit
**17*a, b, c*** discharge conveyor belt
**17*a*** portioning belt
18 gripper guide
20 feed unit
21 offcut conveyor
22 weighing belt
23 discharge belt, compensator belt
24 distributor belt
25 compensation belt
26 format belt

27 1st/2nd/3rd buffer belt
28 insertion belt
29 scales
30 buffer belt
31 further buffer belt
32 conveyor belt
33 (first) format belt
34 (second) format belt
35 sensor unit
36 further sensor unit
100 cutting machine, slicer
200 insertion/feed unit
230 buffer stretch
300 packaging machine
301 insertion station
302 supply roll
303 upper die
304 lower die
F format, complete format (portions)
F* incomplete format (portions)
F' analogous format (troughs)
K product, product type
M trough
S slice
SP1-SP4 track
TB deep-drawing belt
P portion
V packaging means

What is claimed is:

1. A method for operating a packaging line including a packaging machine having an insertion station in which one portion is deposited on or in a packaging means, a single-track or multi-track cutting machine for cutting off slices from a product, including a discharge conveyor unit for the slices, the discharge conveyor unit being capable of forming the slices into portions, and an insertion/feed unit downstream in a passage direction of the single-track or multi-track cutting machine for buffering and feeding the portions to the insertion station by a plurality of conveyor belts, wherein a set of the plurality of conveyor belts arranged within a buffer stretch are used as buffer belts, wherein the portions are assembled by the insertion/feed unit to a complete format comprising a predetermined number of portions, each at a predetermined distance from another in the passage direction, and wherein the complete format is fed to the insertion station by an insertion belt of the insertion/feed unit, the method comprising:

initially assembling on a last conveyor belt and/or a penultimate conveyor belt of the insertion/feed unit before the insertion belt, in the passage direction, an incomplete format in the passage direction, and forming the complete format from the incomplete format only upon transfer of the portions to the insertion belt, wherein upon transfer of the portions to the insertion belt, in order to form the complete format, a conveyor belt of the insertion/feed unit upstream of the last and/or the penultimate conveyor belt in the passage direction, can be driven in the passage direction before the last and/or the penultimate conveyor belt is driven in the passage direction, in order to add the last portion or the last row of portions to the incomplete format at a spacing in the passage direction that is correct for the complete format.

2. The method according to claim 1, wherein the incomplete format differs from the complete format at least in that the incomplete format lacks a last portion or last row of portions, in the passage direction, of a complete format, and the last portion or the last row of portions is added to the incomplete format to form the complete format only upon transfer of the portions to the insertion belt.

3. The method according to claim 1, wherein in order to assemble the portions, to a format in the passage direction, a position of a respective portion can be acquired upstream of the last or the penultimate conveyor belt of the insertion/feed unit, before the insertion belt, in the passage direction of the single-track or multi-track cutting machine, by a sensor unit.

4. The method according to claim 1, wherein during a cutting operation of the cutting machine, a number of portions, in the passage direction, is buffered at the same time on a buffer belt of the buffer stretch, wherein the number is higher than the predetermined number of portions of a format in the passage direction, and/or the single-track or multi-track cutting machine is a multi-track cutting machine, and a number of rows of portions is buffered simultaneously on a buffer belt of the buffer stretch, wherein the number is higher than a number of rows of a format.

5. The method according to claim 1, wherein the single-track or multi-track cutting machine is a multi-track cutting machine having a plurality of tracks, and portions, located on adjacent tracks, before the buffer stretch in the passage direction, are moved into an identical position in the passage direction by a compensation belt of the insertion/feed unit.

6. The method according to claim 1, wherein the single-track or multi-track cutting machine is a multi-track cutting machine having a plurality of tracks, and portions, located on adjacent tracks, before the buffer stretch in the passage direction, are moved to a track spacing of the tracks of the packaging machine by a distributor belt or a spreader belt of the insertion/feed unit.

7. The method according to claim 1, wherein the packaging means are moved forwards in a stepwise manner in the packaging machine, receiving the complete format, comprising a plurality of portions per track.

* * * * *